US009730499B2

(12) United States Patent
Ford

(10) Patent No.: US 9,730,499 B2
(45) Date of Patent: Aug. 15, 2017

(54) CONVERTIBLE CARRYING BAG

(71) Applicant: NIKE, Inc., Beaverton, OR (US)

(72) Inventor: Timothy J. Ford, Portland, OR (US)

(73) Assignee: NIKE, INC., Beaverton, OR (US)

( * ) Notice: Subject to any disclaimer, the term of this patent is extended or adjusted under 35 U.S.C. 154(b) by 24 days.

(21) Appl. No.: 14/599,067

(22) Filed: Jan. 16, 2015

(65) Prior Publication Data

US 2016/0206061 A1 Jul. 21, 2016

(51) Int. Cl.

| | |
|---|---|
| ***A45F 3/02*** | (2006.01) |
| ***A45C 7/00*** | (2006.01) |
| ***A45C 13/30*** | (2006.01) |
| ***A45C 9/00*** | (2006.01) |
| *A45F 4/02* | (2006.01) |
| *A45F 3/04* | (2006.01) |
| *A45C 3/00* | (2006.01) |

(52) U.S. Cl.

CPC ..... *A45C 7/0059* (2013.01); *A45C 9/00* (2013.01); *A45C 13/30* (2013.01); *A45F 3/02* (2013.01); *A45C 7/0063* (2013.01); *A45C 2003/008* (2013.01); *A45C 2009/007* (2013.01); *A45F 3/047* (2013.01); *A45F 2003/025* (2013.01); *A45F 2004/023* (2013.01)

(58) Field of Classification Search

CPC ..... A45F 3/02; A45F 3/047; A45F 2004/023; A45C 7/0063

USPC ..... 224/578, 579, 654, 659; 190/103, 105

See application file for complete search history.

(56) References Cited

U.S. PATENT DOCUMENTS

| | | | | | |
|---|---|---|---|---|---|
| 294,622 | A | * | 3/1884 | Roser | A63B 55/00 224/236 |
| 924,172 | A | * | 6/1909 | Merzbach | A45C 3/06 150/100 |
| 1,636,838 | A | * | 7/1927 | Roser | A45C 7/0063 190/103 |
| 3,122,225 | A | * | 2/1964 | Ward | A45C 7/0063 190/108 |
| RE25,826 | E | * | 8/1965 | Ward | A45C 7/0063 190/108 |
| 3,254,816 | A | * | 6/1966 | Gray | A45F 3/04 224/630 |
| 4,334,601 | A | * | 6/1982 | Davis | A45C 3/00 190/111 |
| 4,679,242 | A | * | 7/1987 | Brockhaus | A45C 3/04 190/1 |
| 4,826,060 | A | * | 5/1989 | Hollingsworth | A45C 3/00 224/237 |
| 4,830,154 | A | * | 5/1989 | Gerch | A45C 3/00 190/103 |

(Continued)

FOREIGN PATENT DOCUMENTS

KR 101003750 B1 12/2010

OTHER PUBLICATIONS

International Search Report with Written Opinion dated Mar. 22, 2016 in Application No. PCT/US2016/013556, 11 pages.

*Primary Examiner* — Justin Larson
(74) *Attorney, Agent, or Firm* — Shook, Hardy & Bacon, LLP

(57) ABSTRACT

A duffel bag can be reversibly converted to a cross-over bag by restricting the storage volume of the bag at one end. Optionally, a carrying strap may be adjusted from a central anchor to an outer anchor to facilitate draping the carrying strap over a shoulder.

20 Claims, 7 Drawing Sheets

(56) References Cited

U.S. PATENT DOCUMENTS 4,919,240 A * 4/1990 Tobias ..... A45F 3/02 150/108
5,143,188 A * 9/1992 Robinet ..... A45C 3/00 150/117
5,211,716 A * 5/1993 Tobias ..... A45C 3/02 150/108
5,497,919 A * 3/1996 Klinger ..... B62J 9/001 190/109
5,577,652 A * 11/1996 Cooper ..... A45F 3/04 224/153
5,769,295 A * 6/1998 Alves ..... A45F 3/02 224/578
5,927,581 A * 7/1999 Reddy ..... A45F 3/02 224/153
6,053,382 A * 4/2000 Wyant ..... A45F 3/042 190/103
6,138,881 A * 10/2000 Paul ..... A45F 3/02 224/153
6,152,343 A * 11/2000 Shin ..... A63B 55/408 224/259
6,164,509 A * 12/2000 Gausling ..... A45F 3/047 224/153
6,220,493 B1 * 4/2001 Iijima ..... A45F 3/00 224/153
D444,298 S * 7/2001 Starck ..... D3/276
6,257,472 B1 * 7/2001 Freedman ..... A45F 3/04 150/108
6,390,345 B1 * 5/2002 Brown ..... A45C 3/00 190/110
6,394,328 B1 * 5/2002 Zakarin ..... A45F 3/04 150/108
6,460,746 B1 * 10/2002 Amram ..... A45F 3/047 224/579
6,591,950 B1 * 7/2003 Scicluna ..... A45C 7/0027 190/103
6,609,598 B2 * 8/2003 Hsu ..... A45C 7/0027 190/103
6,793,112 B2 * 9/2004 Ammerman ..... A45F 3/02 224/257
7,204,399 B2 * 4/2007 Collier ..... A45F 3/047 224/153
8,234,758 B2 * 8/2012 Liu ..... A45F 3/02 24/265 H
8,978,850 B2 * 3/2015 Bettua ..... A45C 7/0068 190/103
8,998,051 B2 * 4/2015 Demskey ..... A45C 13/30 224/579
9,095,201 B2 * 8/2015 Simonsen ..... A45F 5/00
9,125,478 B2 * 9/2015 Li ..... A45F 3/047
D754,440 S * 4/2016 Ford ..... D3/318
2004/0065708 A1 * 4/2004 Amram ..... A45F 3/047 224/579
2006/0262996 A1 11/2006 Vazquez
2015/0060221 A1 * 3/2015 Bourette ..... A45C 5/14 190/18 A
2015/0208790 A1 * 7/2015 Pylkovas ..... A45F 3/02 224/578
2016/0058142 A1 * 3/2016 Buynar ..... A45C 3/12 150/113

* cited by examiner

CONVERTIBLE CARRYING BAG

TECHNICAL FIELD

The present disclosure relates to a carrying bag, particularly to a bag style commonly referred to as a duffel bag. More particularly, the present disclosure relates to a duffel bag that can be reversibly converted to a cross-body carrying bag.

BACKGROUND

Various styles of carrying bags are available. One popular style is a duffel bag, which tends to be generally rectangular, tubular or cylindrical and is carried using a long shoulder strap or shorter straps for hand-carry. Another popular style is a cross-body bag, also referred to as a messenger-style bag. A cross-body bag generally has a strap that is worn over one shoulder, diagonally across the body to the waist or hip opposite the carrying shoulder, with the bag resting against the back or the rear of the hip.

A duffel bag with a sufficiently long strap can be draped across the body, but carrying a duffel bag in this way can present challenges (e.g., comfort, load management, bag positioning, etc.). That is, often the shape of the bag influences how the bag sits against the body and the distribution of the contents of the bag, both of which can make a typical duffel bag less than perfect to carry across one's body. If a duffel bag is donned, it is typically worn in a backpack configuration, with straps over both shoulders, and the duffel bag oriented vertically, generally along the spine of the person wearing the bag.

A person selecting and carrying a bag may wish to have the capacity and carrying options of a duffel bag, but also wish to be able to wear the bag in a cross-body configuration under certain circumstances. For example, a duffel bag may be more convenient when carrying certain types of items, and the compact, generally uniform size of the duffel bag is useful for stowing the bag or otherwise securing to a rack. On the other hand, a messenger bag may be more convenient if walking, jogging, biking, skateboarding, roller-skating or otherwise traveling in a manner where the bag must be carried rather than stowed. It may be inconvenient to transfer bag contents between a duffel bag and a cross-body bag depending on travel circumstances.

BRIEF SUMMARY

This Summary provides a high-level overview of the disclosure and introduces a selection of concepts that are further described in the Detailed Description below. This Summary is not intended to identify key features or essential features of the claimed subject matter, nor is it intended to be used as an aid in isolation to determine the scope of the claimed subject matter.

The present invention generally relates to a carrying bag, and, more particularly, to a bag that is reversibly convertible between a duffel bag style and a cross-body bag style. In general, the bag comprises a closure or adjustment mechanism along one side end of the bag that, when closed or joined, collapses a portion of the bag, reducing the interior volume of the bag near the closure or joining mechanism. Collapsing a portion of the bag near one end of the bag tends to shift items within the bag to the other end of the bag, making the shape and weight distribution of the bag more like a cross-body bag than a duffel bag. If the person carrying the bag needs additional storage volume inside the bag, or does not desire to carry the bag in a cross-body configuration, the closure or adjustment mechanism can be released, returning the bag to a duffel bag shape and volume.

Other aspects of the bag may be varied from a conventional duffel bag and/or cross-body bag to ensure that those aspects are functional in both configurations of the bag. For example it is common to have an exterior pocket or separate compartment on one or both side ends of a duffel bag. The exterior pocket or compartment, if present, may open generally toward a side of the bag, rather than the top of the bag, so that the pocket or compartment may be more accessible in a cross-body configuration. The bag may also provide an assortment of carrying and/or support straps, enabling hand or shoulder carry in the duffel configuration, and, optionally, providing a strap that can be worn about the waist or hips to provide a more comfortable fit and/or weight-bearing support in the cross-body configuration. In some versions of the bag, the carrying strap may be movable between anchor points on the bag, to make the bag comfortable to carry as a duffel bag, as a cross-body bag over the right shoulder, or as a cross-body bag over the left shoulder.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The present invention is described in detail below with reference to the attached drawing figures, which are incorporated herein by reference, wherein.

DETAILED DESCRIPTION

The subject matter of aspects of the present invention is described with specificity herein to meet statutory requirements. But the description itself is not intended to necessarily limit the scope of claims. Rather, the claimed subject matter might be embodied or carried out in other ways to include different elements or combinations of elements similar to the ones described in this document, in conjunction with other present or future technologies.

In general, this disclosure relates to a bag that can be reversibly converted from a duffel bag to a cross-body bag and back. For example, FIGS. 1-4 illustrate the bag in a duffel-bag configuration, and FIGS. 5-8 illustrate the bag in a cross-body configuration. In general, this conversion is facilitated by changing the shape and weight distribution of the bag and, or alternatively, by changing one or more strap configurations.

Figure 1:
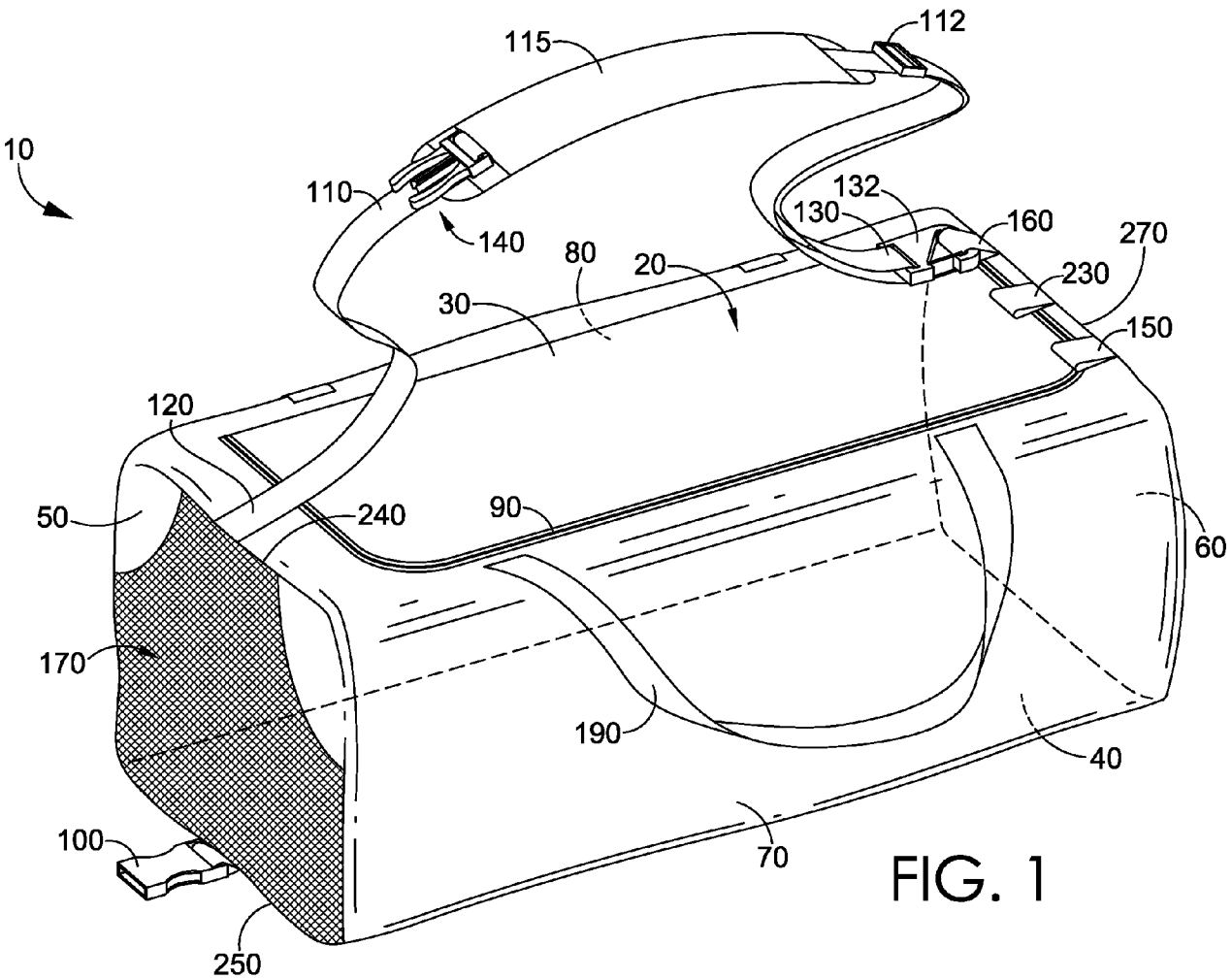
FIG. 1 is a perspective view of an exemplary duffel bag illustrating some aspects of the disclosure.

Referring initially to FIG. 1, a bag 10 is depicted that includes a first end 50 and a second end 60, a top 30 and a bottom 40, and a front 70 and a back 80, which at least partially enclose a storage compartment 20. The storage compartment 20 is accessible from outside the storage compartment by an opening 90, which may occur in any part of a wall or combination of walls (e.g., opening 90 may span two or more walls, or may lie wholly or in part in one or more shoulders or junctions between walls). In addition, the storage compartment 20 has a volume defined by the first end wall 50, the second end wall 60, the top 30, the bottom 40, the first side wall 70, and the second side wall 80. The first side wall 70 is disposed between the top wall 30 and the bottom wall 40, and between the first end wall 50 and the second end wall 60. The second side wall 80 is opposite the first side wall 70, and disposed between the top wall 30 and the bottom wall 40, and disposed between the first end wall 50 and the second end wall 60.

Although these elements are depicted as sides, walls, ends, faces, and the like, for illustrative purposes, and although they might be referred to as separate elements, the bag may be formed of a single piece of material, or of three or more separate pieces of material (e.g., two side ends and a tubular body between the two side ends; or two side ends, a bottom piece, and a top piece that encompasses the front, back, and top of the bag; or two side ends and four body pieces—top, bottom, front, and back). For joining the ends of a single piece of material or joining separate pieces of material together, any suitable joining method may be used, including, without limitation, stitching, heat welding, ultrasonic welding, plasma welding, gluing, and the like, or combinations thereof.

Moreover, if there are not distinct sides or walls to the bag (e.g., if two or more sides are continuous, in that they are not clearly delineated by the construction of the bag) the sides are distinguished by respective orientation. For example, the front facing side does not sit on the ground when the bag is properly placed on the ground in a duffel configuration, rather, the bottom or base generally sits on the ground and the front facing side faces towards the viewer. Ambiguous areas in between the sides may be referred to as shoulders or joints. For example, a tubular duffel bag will have a clearly upward-facing top surface, and a clearly forward-facing front surface. In this example, if the tubular body of the bag is formed of a continuous piece of material, there will not necessarily be a seam or joint to define where the top ends and the front begins. However, in this example, the tubular body of the bag would have a rounded shoulder between the top and the front walls at the junction between the top and front walls.

The bag 10 further includes a carrying strap 110, and one or more support handles 190. The carrying strap 110 might be coupled, or anchored, to the bag 10 at various positions and disposed generally along the top 30 of the bag 10, between the first end 50 and second end 60. The carrying strap 110 may be relatively permanently joined to one or both ends 50, 60 of the bag 10, or may be repositionable along one or both ends 50, 60. The figures identify a first junction 240 at which the first end 50 interfaces with the top 30 and a third junction 270 at which the second end 60 interfaces with the top 30, and the strap 110 might be connected to the bag 10 near one or both junctions.

In one aspect, the strap 110 includes a first end 120 that might be attached near the first junction 240 by a means not intended to be releasable, such as by stitching, welding, adhering, etc. However, other connections are possible near the first junction 240 as will be described in other parts of this description. In addition, the bag 10 includes a set of variably positioned anchors 150, 160, and 230 near the second end 60 and the third junction 270. As such, the strap 110 includes a connection mechanism 132 at a second end 130 that releasably attaches to the anchors 150, 160, and 230. For example, the anchors are depicted as webbing loops, such that the connection mechanism 132 of the strap 110 might include various types of hooks, spring-gated loops or carabiners, clips, and the like. In another aspect, the anchors 150, 160, and 230 might include a part of a connection system that mates with the connection mechanism 132, such as a hook-and-loop fastener, a male/female connector, and the like. As will be described in other parts of this description, the variably positioned anchor points allow an orientation of the strap 110 to be arranged (e.g., diagonally across the top 30) for carrying the bag cross-body.

The bag 10 may have two or more anchors 150, 160 adjacent the top wall 30 and spaced along the second end wall 60, such that at least one anchor 150 is nearer the first side wall 70 than at least a second anchor 160, which is nearer the second side wall 80. Additional anchors, if present, may be placed generally along the second end wall 60 between the first side wall 70 and the second side wall 80. Additional anchors, if present, need not be arranged in a line, and may instead be placed in an arcuate, zigzag, or other pattern generally near the second end wall 60. The second end 130 of the carrying strap 110 may be reversibly joined to any of the anchors 150, 160 along the second end wall 60.

If the bag is donned in a cross-over configuration (e.g., FIGS. 7 and 8), connecting the second end 130 of the carrying strap 110 nearer the first side wall 70 may facilitate donning the bag over one's left shoulder (i.e., so that the strap sits on top of the left shoulder when worn). Connecting the second end 130 of the carrying strap 110 nearer the second side wall 80 may facilitate donning the bag over one's right shoulder (i.e., so that the strap sits on top of the right shoulder when worn). The bag 10 may also have the anchor 230 along the second end wall 60 near the midline between the first side wall 70 and the second side wall 80, for carrying the bag in a duffel configuration.

In a further aspect, the strap 110 includes a strap support 115 that provides cushioning and pressure dispersion when the strap 110 is positioned over a shoulder (e.g., when carrying the bag 10). The strap support 115 might include a tubular sleeve having various types of cushioning, such as foam or fluid-filled pockets. As such, the strap support 115 is movable along the strap 110 (e.g., by sliding) to adjust a position of the strap support 115. For example, a length of the strap 110 might be adjusted using a buckle 112 and it might be desirable to reposition the strap support 115 (e.g., to a central position) based on the adjusted length of the strap 110.

Figure 3:
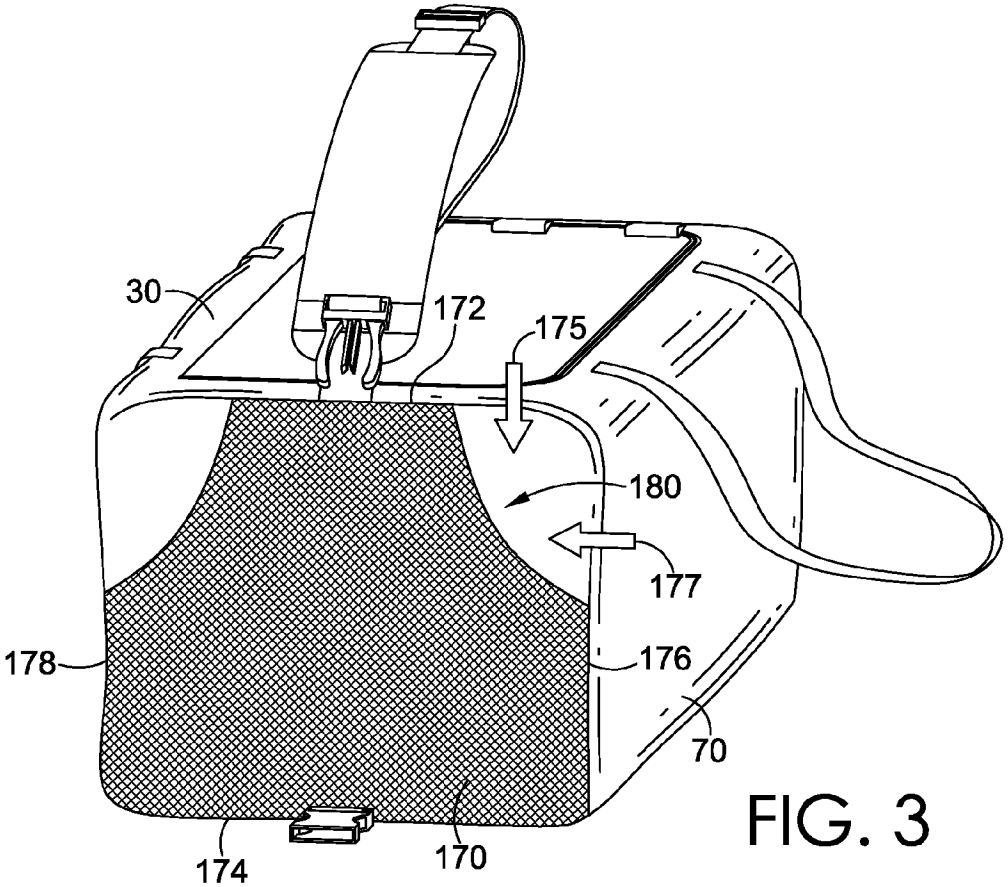
FIG. 3 is a perspective view of an end of the exemplary duffel bag in accordance with an aspect hereof.
Figure 4:
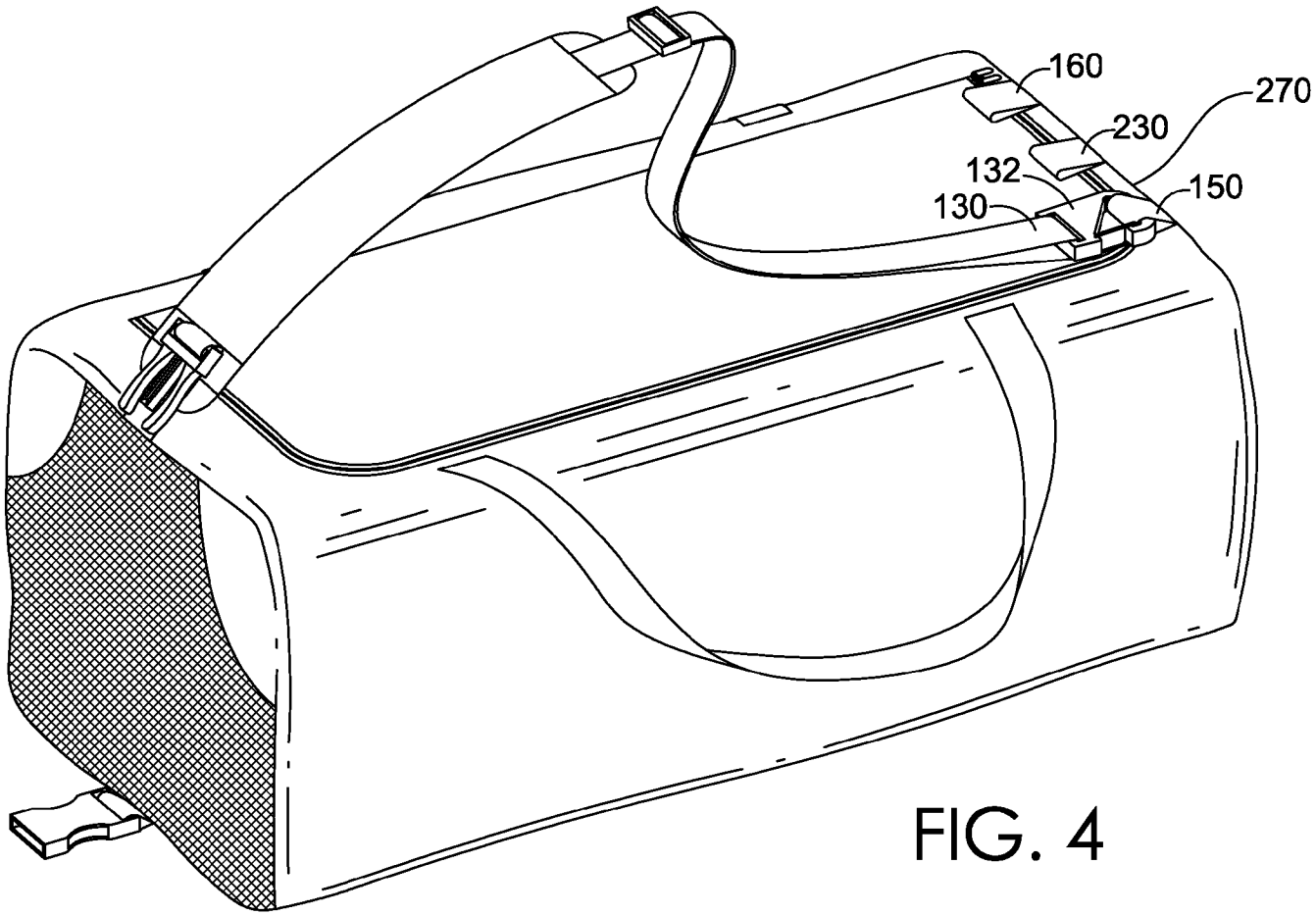
FIG. 4 shows another view of a carrying-strap configuration in accordance with an aspect hereof.

The bag 10 also includes a pocket 170 on the exterior of first end 50, and a view of the pocket 170 is depicted in FIG. 3. The pocket 170 might include a separate piece of material or textile that is joined to the bag 10 and that extends across an exterior surface of at least part of the first end 50. In some embodiments, pocket 170 may be formed of mesh or netting, or the material forming the pocket (which may be the same as or different than the material forming first end 50) may be vented or pierced or may be selected for inherent breathability.

The pocket includes a top edge 172 oriented towards the top 30 of the bag, a bottom edge 174 oriented towards the bottom of the bag, a first edge 176 oriented towards the first side 70 of the bag, and a second edge 178 oriented towards the second side 80 of the bag. In one aspect, the pocket 170 includes an opening 180, which is oriented generally diagonally from the top edge 172 of the pocket towards the first edge 176 of the pocket. That is, at least a portion of the first edge 176 is not attached directly to the bag 10, such that an item can be passed between the first edge 176 and the first end 50 to store the item in the pocket 170. Thus the pocket 170 is accessible from both a side-entry vantage (represented by arrow 177) and a top-entry vantage (represented by arrow 175). In another aspect, another opening that is similar to the opening 180 might be positioned along a portion of the second edge 178 of the pocket 170. As will be described in other portions of this description, the pocket 170 might be accessible when the bag is in both the duffel configuration and in the cross-body configuration. As shown in the figures, the top edge 172 of the pocket 170 lies along junction 240, and the bottom edge 174 of the pocket 170 lies along junction 250, however, there need not be any particular proximity between the edges of the pocket 170 and the junctions of the bag.

In a further aspect, the duffel bag includes an adjustment mechanism that reduces a distance between the first junction 240 and a second junction 250, which is near the interface between the top 30 and the bottom 40. Among other things, reducing the distance can collapse the first end 50 and reduce a volume of the storage compartment 20 proximal the first end 50. An example of a collapsed first end 50 is illustratively depicted in FIG. 5. The adjustment mechanism might include various types of adjusters. For example, the adjustment mechanism might include a first component that is positionable near the first junction 240 and that is releasably securable near the second junction 250. In addition, the adjustment mechanism might include a second component that is positioned near the second junction 250 and is securable near the first junction 240. The adjustment mechanism might also include a first mechanism near the first junction 240 and a second mechanism near the second junction 250, the first and second mechanisms being releasably connectable.

Figure 2:
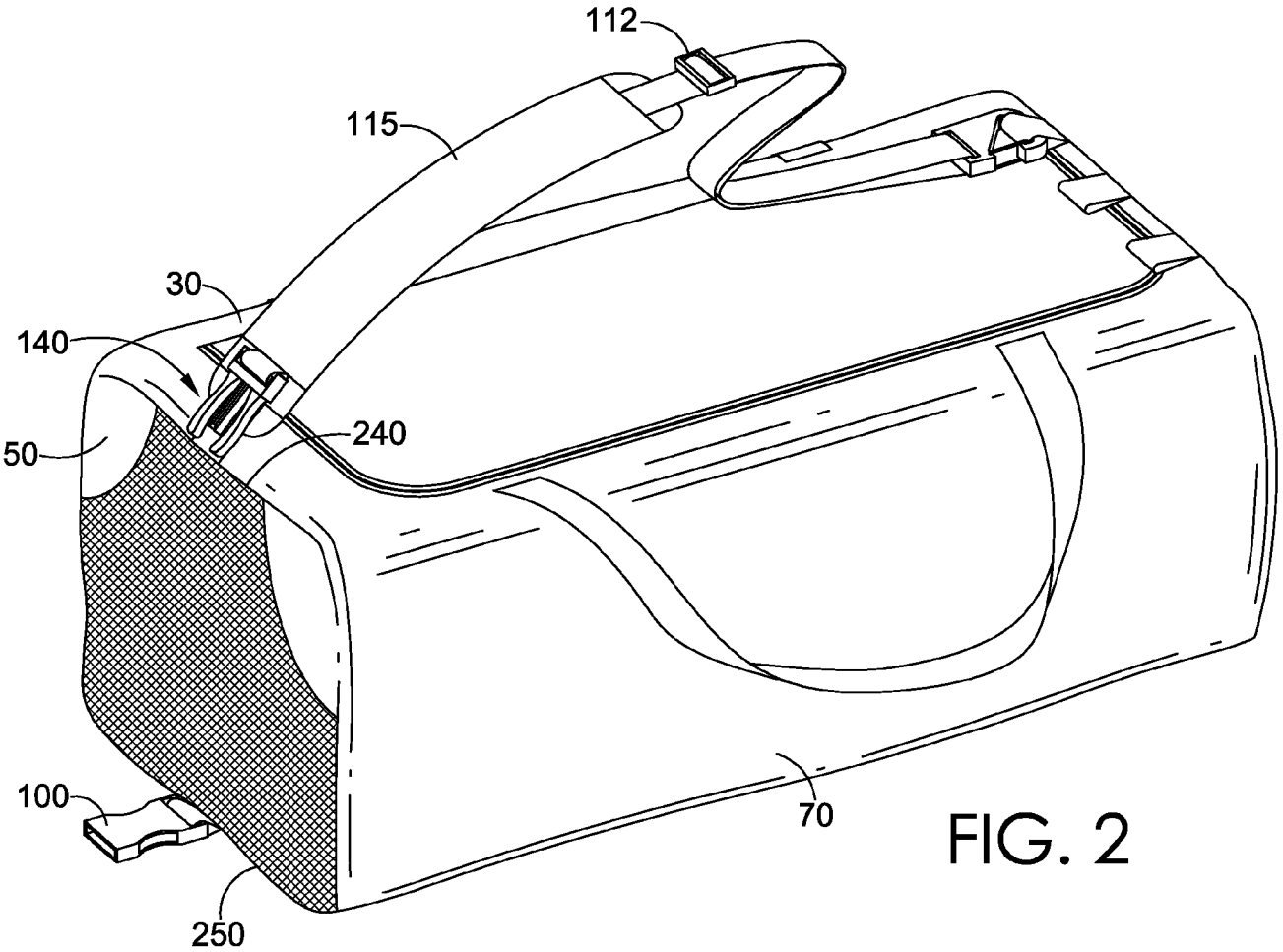
FIG. 2 shows an exemplary carrying-strap configuration in accordance with an aspect hereof.

The illustrative figures described herein depict one aspect in which the adjustment mechanism includes a first releasable connector 140 that releasably mates with a second releasable connector 100. For example, the first releasable connector 140 is affixed to the strap support 115, which is slidable towards the first junction 240 (as depicted in FIG. 2). Thus, the first releasable connector is positionable near the first junction 240 without necessarily being attached directly to the top 30 or the end 50. The first releasable connector 140 is connectable to the second releasable connector 100, as depicted in FIG. 5.

Figure 5:
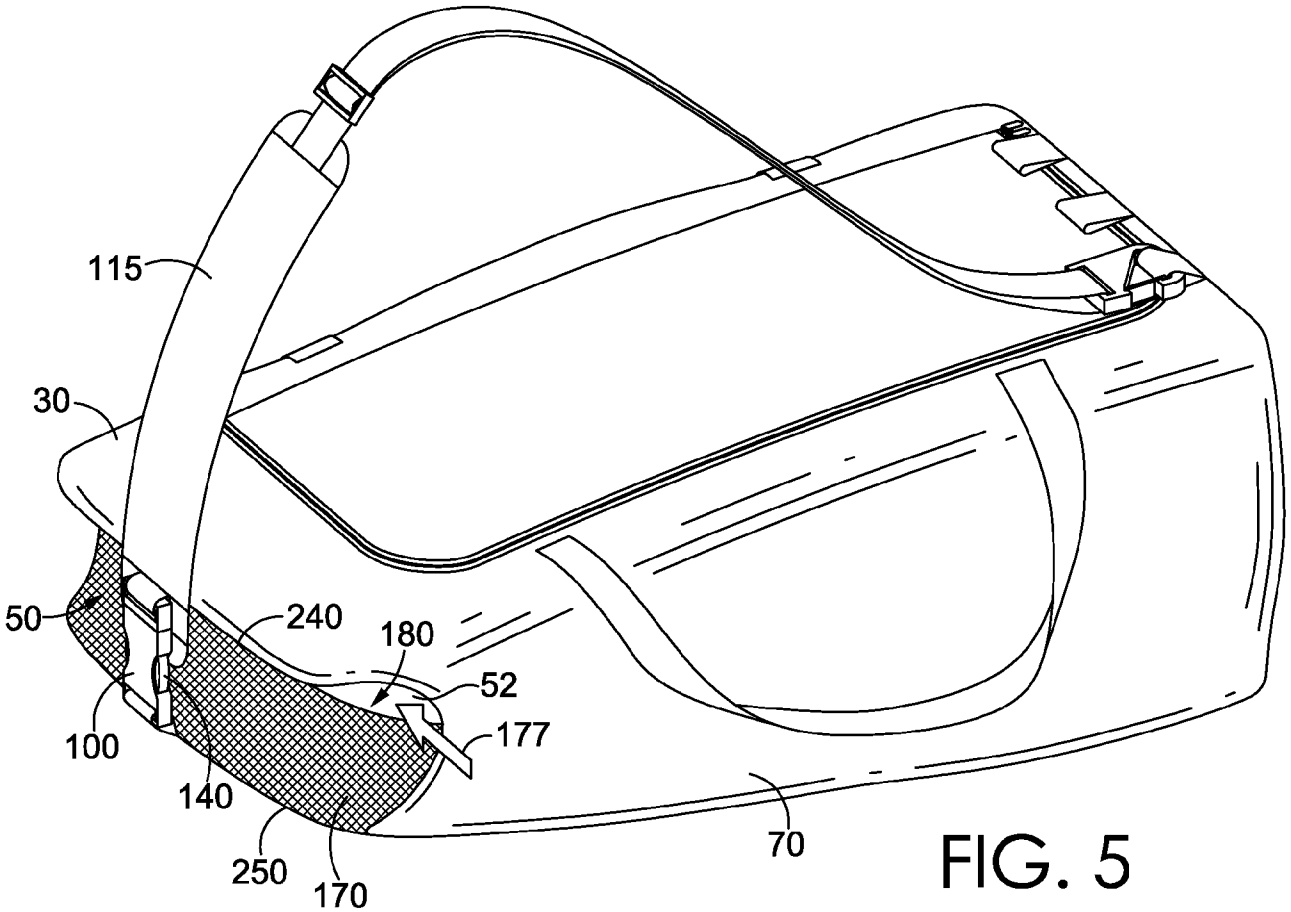
FIG. 5 shows the exemplary duffel bag with an end wall collapsed in accordance with an aspect hereof.

When actuated, the illustrative adjustment mechanism 140 and 100 reduces a distance between first junction 240 and second junction 250, collapsing first end 50 (shown collapsed in FIG. 5). When first end 50 collapses, the volume of storage compartment 20 proximal first end 50 is reduced. In addition, attachment of the first connector 140 and the second connector 100 effectively retains the strap support 115 near the end 120 of the strap 110 and near the end 50 of the bag, which can be oriented towards the shoulder of a wearer (as opposed to the hip) when the bag is donned in a cross-body manner. Retaining the strap support 115 near the collapsed end 50 helps to secure the load and impede possibly undesirable shift. That is, if the strap support 115 is not retained near the end 50 when the bag is worn over one's shoulder, then shifting of the main compartment might cause the strap 110 and strap support 115 to slide with respect to one another and undesirably change the position of the as-worn bag. Thus, actuating the releasable connectors 140 and 100 serves a dual function by both reducing the volume of the end 50 of the bag and retaining the strap support 115 in position.

The first releasable connector 140 is depicted as fixedly coupled to the strap support 115. But in other aspects, the first releasable connector 140 might be fixed directly to the strap 110 or directly to the bag 10 near the first junction 240. In addition, the first releasable connector 140 may be attached directly to carrying strap 110, or may be attached indirectly to carrying strap 110, as by a short loop, secondary strap, or tab. The connector 140 may be attached to carrying strap 110 and directly to bag 10, or may be attached indirectly to bag 10 and directly or indirectly attached to carrying strap 110. When the first connector 140 is not fixedly coupled to the strap support 115, then other elements might be utilized to provide a strap support that is retained near the end 50. For example, a strap support might be non-slidably affixed near the end 120 of the strap 110. Or an additional releasable fastener might be included that attaches the strap support 115 to the bag near the first junction 240 or to the end 120 of the strap 110.

The bag may have the mating mechanism 100 on the outside of storage compartment 10. The mating mechanism 100 may be adjacent to the bottom wall 40. The mating mechanism 100 may be adjacent to the first end wall 50. The first mating mechanism 100 may be nearer a midline along the first end wall 50 between the first side 70 and the second side 80 than to either the first side 70 or the second side 80. The mating mechanism 100 may be attached directly to the bag 10, or may be attached indirectly to the bag 10 via a short loop, strap, or tab. The mating mechanism 100 may be attached to the bottom wall 40 or the first end 50 or both (e.g., along junction 250). In some arrangements, the mating mechanism 100 is not attached to the bag 10 on or along the first side wall 70.

The bag 10 may have the adjustment mechanism (e.g., first and second connectors 100 and 140) on the outside of the storage compartment 20. The adjustment mechanism may be adjacent to top wall 30. The adjustment mechanism may be adjacent to the first end wall 50. The adjustment mechanism may be nearer a midline along the first end wall 50 between the first side 70 and the second side 80 than to either the first side 70 or the second side 80. The adjustment mechanism may be attached directly to the bag 10, or may be attached indirectly to the bag 10 via a short loop, strap, or tab. The adjustment mechanism may be attached to the top wall 30 or first end wall 50 or both (e.g., along junction 240). In some embodiments, the adjustment mechanism is not attached to the bag 10 on or along the first side wall 70.

The first connector 140 may be reversibly mateable with the second connector 100. When the first connector 140 is mated to the second connector 100, the first end wall 50 at least partially collapses. When the first end wall 50 at least partially collapses, the volume of the storage compartment 20 proximal to the first end wall 50 is reduced. This facilitates a passive shift of contents of the bag (if any) away from the first end 50 and toward the second end 60, with a corresponding shift in the weight distribution of the bag (if there are contents in the bag). That is, by restricting the volume on only one end of the bag, the contents will tend to move toward the open space at the other end of the bag without having to re-pack the bag.

In some aspects, the adjustment mechanism that reduces the volume near the first end 50 does not wrap around the tubular section of the bag 10, in particular, around two or more of top wall 30, bottom wall 40, first side 70, and/or second side 80. The adjustment mechanism may not traverse a substantial portion, i.e., 20% or more, of the depth of first side wall 70. The adjustment mechanism may have no direct contact with first side wall 70. Conventional tie down straps have been used to secure the contents of a bag relative to the location of the contents in the bag, i.e., to prevent the movement of items within the bag. Conversely, the adjustment mechanism functions to close off a portion of the volume of the bag, which can encourage the passive movement of the bag contents (if any) toward second end wall 60.

In the figures, the releasable connectors 140 and 100 are depicted as a male/female style clip system. However, the adjustment mechanism might include a variety of other releasable fasteners, such as hook-and-loop fasteners, snaps, buttons, zippers, male-female clips, hook-and-eye fasteners, carabiner clips (in combination with other clips or in combination with loops or rings), magnets, ring-and-stud (like a cuff-link), and combinations thereof. In addition, the figures depict a single set of mating mechanisms, and in other aspects, the bag 10 might include a plurality of mating mechanisms, which might be the same or different. Among other things, a plurality of mating mechanisms can provide a more robust and secure connection. The two or more closure mechanisms may be intended to be used together, or a second or later closure mechanism may be more robust than the first closure mechanism (useful, e.g., if the bag is more full or contains heavier items), or using two or more closure mechanisms may be more robust than using only the first closure mechanism. If more than one closure mechanism is present, the closure mechanisms may be of the same kind or different kinds.

Other adjustment mechanisms might also, or alternatively, be included that reduce the distance between the first junction 240 and the second junction 250. For example, an elongated strip (e.g., strap, webbing, etc.) might extend between the first junction 240 and the second junction 250. The elongated strip might be contiguous with the strap 110, or might be a separate strip. In addition, the elongated strip is fixedly coupled near one of the first junction 240 or the second junction 250 and is slidably coupled to the other of the first junction 240 or the second junction. For example, the adjustment mechanism might include a slide mechanism which can be used to reduce the length of the elongated strip, which would also reduce the distance between first junction 240 and second junction 250. Suitable slideable fasteners and/or slide mechanisms include, but are not limited to, webbing slides, camming slides, buckles, and combinations thereof.

Having described various elements of the bag 10, a conversion of the bag from a duffel-style configuration (e.g. FIGS. 1-4) to a cross-body configuration (e.g., FIGS. 5-8) will now be described. In one aspect, the strap 110 can be moved between different anchor points to allow the bag to be comfortably carried in either the duffel or cross-body configuration. For instance, the third anchor 230 would be a more conventional connection position for carrying a duffel bag over-the-shoulder, although bag 10 could be carried over the shoulder as a duffel bag if the carrying strap 110 is connected to first anchor 150 or second anchor 160. When converting the bag 10 to a cross-body configuration, the strap 110 might be connected to the anchor 150, when the strap will be worn over the wearer's left shoulder and extending across his/her chest towards his/her right hip. Alternatively, the strap 110 might be connected to the anchor 160, when the strap will be worn over the wearer's right shoulder and extending across his/her chest towards his/her left hip. Additional anchor points are possible, and would accommodate different weights and load distributions of the bag, as well as different heights, body shapes, and/or carrying preferences of a person carrying or wearing the bag.

Figure 6:
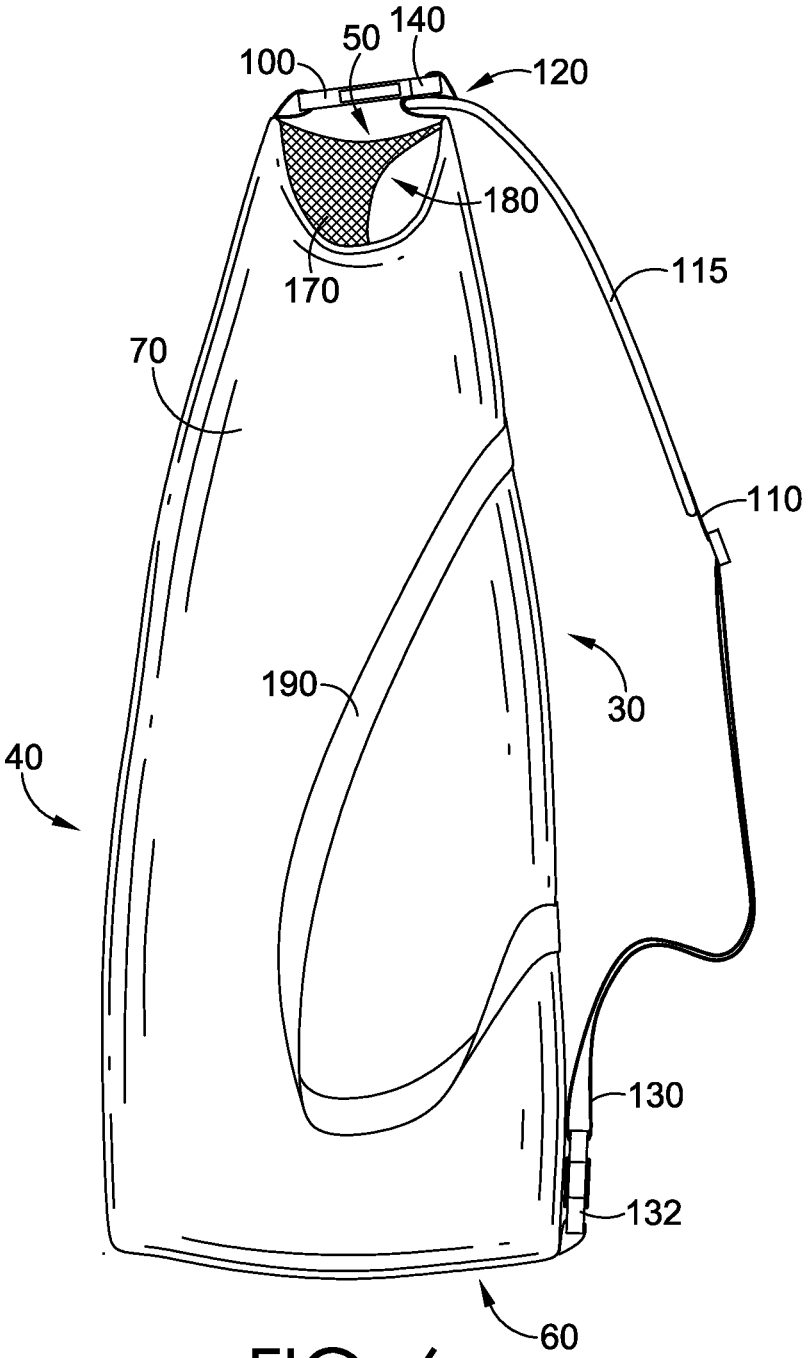
FIG. 6 shows a side view of the exemplary bag in FIG. 5 in accordance with an aspect hereof.
Figure 8:
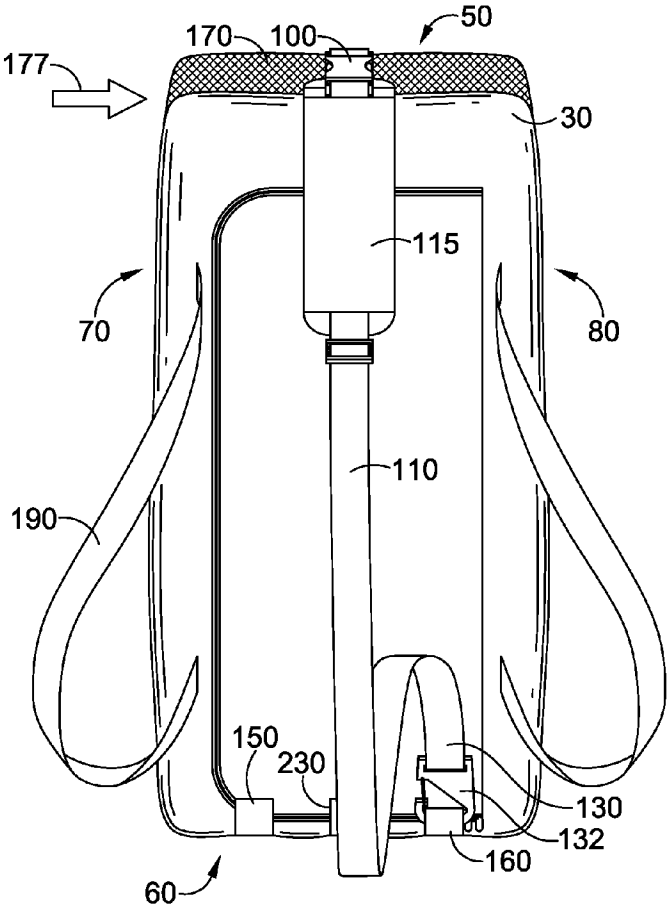
FIGS. 7 and 8 depict respective top views of the bag with the carrying strap anchored in different positions in accordance with an aspect hereof.
Figure 7:
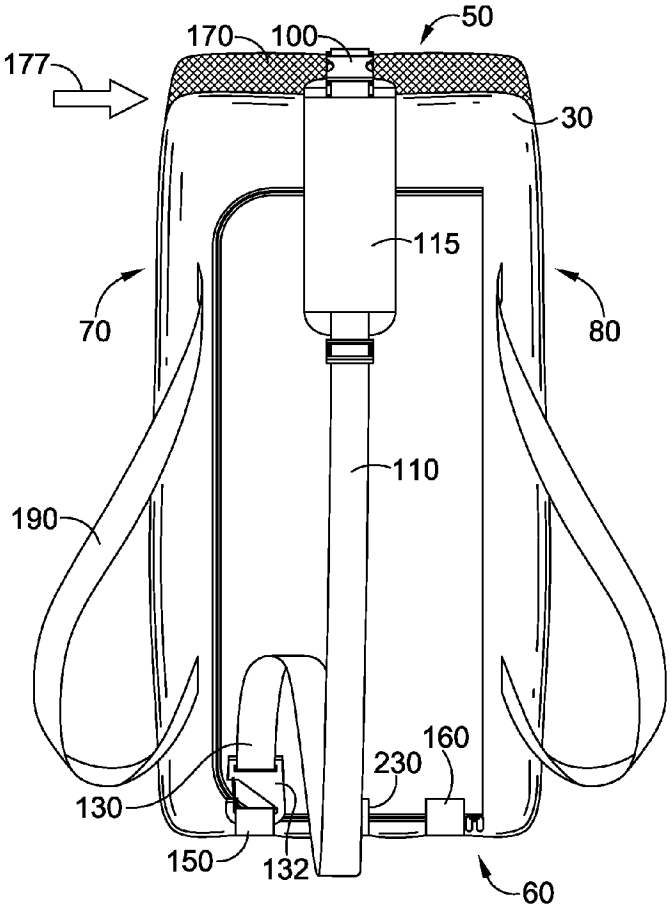

As shown in FIGS. 5 and 6, when the adjustment mechanism (e.g., 100 and 140) is actuated, the distance between the first junction 240 and the second junction 250 is reduced, and the first end 50 at least partially collapses. This changes the shape of the bag, making it generally flatter toward the first end 50 than at the second end 60. The depth of the bag at the first end 50 (the distance between the top 30 and bottom 40 of the bag) may be reduced by a percentage in a range of about 60% to about 90% when the first end 50 at least partially collapses. This makes the first end 50 more suitable for carrying near the rear of the shoulder, like a cross-body bag (e.g., FIG. 6).

By actuating the adjustment mechanism, the contents of the bag (if any) are also shifted toward the second end 60, which makes the bag more comfortable to carry to in a cross-body configuration. The second end 60 has a surface area in the duffel bag configuration 10. In some embodiments, the surface area of the second end 60 is substantially unchanged by actuating the adjustment mechanism. The area is substantially unchanged if it varies by less than 20%, or by less than 10%, when the adjustment mechanism is actuated or deactivated. When the second end 60 does not substantially change surface area, a volume of storage area inside the bag is preserved near the second end 60. This tends to facilitate the passive settling of any contents of the bag toward the second side when the bag is changed from a duffel configuration to a cross-body configuration. The second end 60 may be designed (e.g., by selection of a relatively stiff material relative to the first side of the bag, or by reinforcement, such as layering of the material in the second side, or using composites or layers of different materials in the second side) to be stiffer than the first end 50.

In an additional aspect, releasably attaching the first connector 140 and the second connector 100 retains the strap support 115 in position near the end 50. That is, in aspects in which the first connector 140 is coupled to the strap support 115 (as depicted in the figures), the strap support 115 is indirectly held in position near the first end 50 when the first and second connectors 140 and 100 are actuated. Thus, the strap support 115 is impeded from sliding along the carrying strap 110 when the bag 10 is converted to a cross-body configuration. In this respect, actuating the releasable connectors 140 and 100 serves a dual function by both reducing the volume of the end 50 of the bag and retaining the strap support 115 in position.

FIG. 5 depicts the pocket 170 as it might be oriented when the adjustment mechanism is actuated. In FIG. 5, the first end 50 is collapsed and part of the first end is doubled over onto another part of the first end, which creates a generally concave portion 52. As illustrated, the first edge 176 is positioned along, but not connected to, the concave portion 52, such that the opening 180 provides access to the pocket 170 between the doubled-over portions. Absent this illustrated and described position of the opening 180, the pocket might be less accessible. For example, if the opening 180 were along a portion of the top edge 172 of the opening, the pocket 170 might be harder to access when the first end 50 is collapsed.

In a further aspect, the opening 180 may face generally toward a wearer when the bag is donned in a cross-body configuration (e.g., FIGS. 7 and 8), such that pocket 170 may be accessible by reaching across the front of the body when the bag is being worn in a cross-body configuration. In contrast, if the pocket 170 opened directly toward the top 30 of the bag, it may be closed, or difficult to access, by operation of the adjustment mechanism that converts the bag between a duffel configuration and cross-body configuration. Thus, if pocket 170 opens toward the top 30 of the bag, the pocket 170 is unlikely to be easily accessible while the bag is worn in a cross-body configuration.

The bag may have additional support straps may be wrapped around the torso, waist, or hips of the person wearing the bag, and coupled to another portion of the bag 10, such as to the strap 110 or to another support strap. For example, a connector might be provided between the handle 190 and the strap 110 that is connectable when the bag is worn an a cross-body state, such that the handle 190, the connector, and the strap 110 may serve to keep the bag close to the body, e.g., so that it doesn't bounce excessively against the wearer when the wearer moves. Alternately, the elements might bear some of the weight of the bag. The support strap may be padded, particularly, but not exclusively, if the support strap is weight-bearing. The support strap and/or any portion of the support strap may be adjustable in length, or elastic, or elasticated, or combinations thereof, to accommodate wearers of different sizes and shapes.

Any of the reversible closures described herein may be quick-release closures, operable with one hand. Exemplary quick-release closures include press-fit male/female clip pairs; snaps, buttons, carabiner clips, hook-and-loop fasteners, strap-and-D-ring pairs, and combinations thereof. Quick-release closures may include a spring-loaded gate, for example, in a spring-loaded carabiner clip.

The bag can be made from a single piece of material, or from two or more pieces of like or different materials joined directly or indirectly to one another. Exemplary materials for forming the bag include, without limitation, polyester, nylon, cotton, elastane, leather, suede, faux-leather, faux-suede, hemp, bamboo, polyvinyl chloride, polyurethane, and combinations thereof, including layers or laminates of the same or different materials. The material(s) may be in the form of film, cloth, mesh, netting, or combinations thereof. The material or selected materials used in bag may be water-resistant or water-repellant, inherently or by treatment of the material for hydrophobicity. Water-resistance may be particularly helpful near an exterior pocket (e.g., to reduce or prevent water transmission from condensation on a bottle of water or other cold beverage) or on the bottom and/or second side of the bag (e.g., to reduce or prevent water transmission if the bag is set down on a wet surface, as, for example, outdoors or near a shower, sink, or pool). The material or selected materials used in a bag may be air and/or water permeable (e.g., to allow the transmission of humid air out of the bag, or fresh and/or drier air into the bag), and may be air and/or water permeable unidirectionally or both in and out of the bag.

In some aspects, this disclosure relates to a method for reversibly converting a duffel bag 10 to a cross-body configuration (e.g., FIG. 5-8). The method may comprise providing a duffel bag having (or the duffel bag may have) a flexible storage compartment 20 having an open volume and two opposing ends 50, 60. The method may comprise restricting the open volume proximal one of the ends to create a restricted volume. The method may comprise reducing the volume proximal the first end 50 to create a restricted volume. The method may comprise creating a restricted volume without substantially reducing the volume proximal the second end 60. The method may comprise creating a restricted volume by reducing a distance between the top wall 30 proximal the first end 50 and the bottom wall 40 proximal the first end 50. Reducing the distance between the top wall 30 proximal the first end 50 and the bottom wall 40 proximal the first end 50 may comprise releasably connecting a first mating component (e.g., adjustment mechanism 140) positioned near the junction 240 between the top wall 30 and the first end 50 to a second mating component (e.g., mating mechanism 100) positioned near the junction 250 between the bottom wall 40 and the first end 50.

The method may comprise providing a flexible storage compartment comprising a carrying strap 110 (or the duffel bag may have carrying strap 110). The method may comprise adjusting the carrying strap 110 to extend roughly diagonally across the top wall 30 between the first end 50 and the second end 60. The method may comprise releasably attaching an end (e.g., second end 130) of the carrying strap 110 to a first anchor of a plurality of anchors 150, 160 positioned near second end 60. Reversing the conversion may comprise adjusting carrying strap 110 to form a roughly straight line near the centerline of storage compartment 20 between first side wall 70 and second side wall 80. Reversing the conversion may comprise opening the restricted volume. Opening the restricted volume may comprise disconnecting the first and second mating components.

Duffel bags are often available in a wide range of sizes, with bags having lengths from 13 inches (33.02 cm) to 40 inches (101.6 cm). However, to facilitate conversion to a cross-body bag, it may be desirable for a bag to have a length (the distance from first end 50 to second end 60) of between about 20 inches and about 30 inches. These dimensions provide meaningful volume in the duffel configuration, and can also be carried comfortably by most adults in a cross-body configuration. If it is desired that the bag will sit mostly upright (depending, of course, upon the contents and environment of the bag), when it is set on its second side in the cross-body configuration, the bag may have a ratio of the length to the surface area of the second side between about 1:6 and about 1:10. A bag may further have a bag width between first side 70 and second side 80, and a bag depth between top 30 and bottom 40. For convenient carrying and ease of conversion between a duffel bag and cross-body bag, it may be desirable for the bag to have a length to depth ratio of about 2:1.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A bag comprising:

a storage compartment having a volume, the volume defined by:

a top wall, a bottom wall opposite the top wall, first and second end walls, the first and second end walls opposite one another and joining the top and bottom walls, the first end wall joining the top wall at a first junction and joining the bottom wall at a second junction, a first side wall disposed between the top wall and the bottom wall and between the first and second end walls, and a second side wall opposite the first side wall, the second side wall disposed between the top wall and the bottom wall and between the first end wall and second end walls;

a storage compartment accessible from outside the storage compartment by an opening in one or more of the walls;

an adjustment mechanism coupled near the first junction, the adjustment mechanism collapsing the first end wall and reducing the volume proximal to the first end wall by reducing a distance between the first junction and the second junction, wherein the adjustment mechanism does not traverse a substantial portion of the first side wall; and a strap joined to the bag near the first junction and joined to the bag near a third junction between the top wall and the second end wall;

wherein the strap is coupled to the bag near the second junction, and wherein the adjustment mechanism includes a slidable fastener that is fixedly coupled to the bag near the first junction and is slidably attached to the strap, such that slidably adjusting the slidable fastener along the strap modifies the distance between the first junction and the second junction.

2. The bag of claim 1, wherein the second end wall includes an area and wherein the area remains substantially unchanged when the distance is reduced.

3. The bag of claim 1 further comprising, a second strap joined along the first side wall.

4. The bag of claim 1, wherein the strap comprises a cushioning strap support.

5. The bag of claim 1, wherein the slidable fastener comprises a webbing slide, a camming slide, or a buckle.

6. The bag of claim 1, wherein collapsing the first end wall comprises reducing a depth of the bag at the first end by 60-90%.

7. The bag of claim 1, wherein collapsing the first end wall alters a depth of the bad at the second end by less than 20%.

8. The bag of claim 1, further comprising a strap support slidably attached to the strap, wherein the adjustment mechanism is attached to the strap support.

9. The bag of claim 1, further comprising a waist strap.

10. The bag of claim 1, wherein the bag includes a length to depth ratio of about 2:1 when the first end wall is not collapsed.

11. The bag of claim 1, wherein the adjustment mechanism includes a first mating component attached to the bag near the first junction and a second mating component attached near the second junction, and wherein the first mating component releasably connects to the second mating component to reduce the distance.

12. The bag of claim 11, wherein the first mating component is attached to the strap.

13. The bag of claim 12, wherein a length of the strap is not reduced by mating the first mating component with the second mating component.

14. The bag of claim 1 further comprising, a first strap anchor coupled to the bag near the third junction, and a second strap anchor coupled to the bag near the third junction, the first strap anchor positioned closer to the first side than the second strap anchor, the strap being releasably attachable to the first strap anchor and releasably attachable to the second strap anchor.

15. The bag of claim 14, further comprising a third anchor near the second end wall.

16. The bag of claim 1, further comprising a pocket on an exterior of the first end wall.

17. The bag of claim 16, wherein the pocket has an opening, and the opening is proximal to the first side wall.

18. The bag of claim 17, wherein the pocket has a second opening and the second opening is proximal to the second side wall.

19. A method for converting a duffel bag to a cross-body bag, the duffel bag including a flexible storage compartment having a volume defined by at least a top wall, a bottom wall, a first end, and a second end, the method comprising:

reducing the volume proximal the first end to create a restricted volume, without substantially reducing the volume proximal the second end, by reducing a distance between the top wall proximal the first end and the bottom wall proximal the first end;

wherein reducing the distance includes releasably connecting a first mating component, which is positioned near a top junction between the top wall and the first end, to a second mating component, which is positioned near a bottom junction between the first end and the bottom wall, and wherein releasably connecting the first mating component to the second mating component also retains a cushioned strap support near the first end.

20. The method of claim 19 further comprising, adjusting a carrying strap of the bag to extend diagonally across the top wall from the first end to the second end by releasably attaching an end of the carrying strap to a first anchor of a plurality of anchors positioned near the second end.

* * * * *